US008602115B2

(12) United States Patent
Aguirre et al.

(10) Patent No.: US 8,602,115 B2
(45) Date of Patent: Dec. 10, 2013

(54) GRIP ENHANCED TRACTORING

(75) Inventors: Franz Aguirre, Missouri City, TX (US); Wade D. Dupree, Sugar Land, TX (US); Mark Holly, Sugar Land, TX (US); Derek Copold, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 349 days.

(21) Appl. No.: 12/628,380

(22) Filed: Dec. 1, 2009

(65) Prior Publication Data

US 2011/0127046 A1 Jun. 2, 2011

(51) Int. Cl.
*E21B 23/01* (2006.01)
*E21B 4/18* (2006.01)

(52) U.S. Cl.
USPC ..... 166/382; 166/212; 175/51; 175/99

(58) Field of Classification Search
USPC ..... 175/51, 95, 99, 104, 106; 166/65.1, 166/206, 214, 216, 217, 380, 382
See application file for complete search history.

(56) References Cited

U.S. PATENT DOCUMENTS

| | | | | |
|---|---|---|---|---|
| 4,670,862 | A | 6/1987 | Staron et al. | |
| 5,184,676 | A * | 2/1993 | Graham et al. | 166/66.4 |
| 5,794,703 | A * | 8/1998 | Newman et al. | 166/381 |
| 6,089,323 | A * | 7/2000 | Newman et al. | 166/381 |
| 6,179,055 | B1 | 1/2001 | Sallwasser et al. | |
| 6,273,189 | B1 | 8/2001 | Gissler et al. | |
| 6,427,786 | B2 * | 8/2002 | Beaufort et al. | 175/99 |
| 6,464,003 | B2 * | 10/2002 | Bloom et al. | 166/212 |
| 6,629,568 | B2 * | 10/2003 | Post et al. | 166/382 |
| 6,640,894 | B2 * | 11/2003 | Bloom et al. | 166/212 |
| 6,758,279 | B2 | 7/2004 | Moore et al. | |
| 6,921,825 | B2 | 7/2005 | Baraldi et al. | |
| 6,953,086 | B2 | 10/2005 | Simpson | |
| 7,143,843 | B2 * | 12/2006 | Doering et al. | 175/24 |
| 7,156,192 | B2 * | 1/2007 | Guerrero et al. | 175/51 |
| 7,392,859 | B2 * | 7/2008 | Mock et al. | 175/99 |
| 7,401,665 | B2 * | 7/2008 | Guerrero et al. | 175/61 |
| 7,516,782 | B2 * | 4/2009 | Sheiretov et al. | 166/206 |
| 7,607,497 | B2 * | 10/2009 | Mock et al. | 175/99 |
| 7,624,808 | B2 * | 12/2009 | Mock | 166/382 |
| 7,748,476 | B2 * | 7/2010 | Krueger, V | 175/99 |
| 7,854,258 | B2 * | 12/2010 | Sheiretov et al. | 166/98 |
| 7,954,562 | B2 * | 6/2011 | Mock | 175/99 |
| 7,954,563 | B2 * | 6/2011 | Mock et al. | 175/99 |
| 8,061,447 | B2 * | 11/2011 | Krueger, V | 175/99 |
| 8,069,917 | B2 * | 12/2011 | Bloom et al. | 166/212 |
| 2003/0024710 | A1 * | 2/2003 | Post et al. | 166/382 |

(Continued)

OTHER PUBLICATIONS

International Search Report and Written Opinion dated Aug. 11, 2011 for International Application No. PCT/US2010/058515.

*Primary Examiner* — Jennifer H Gay
(74) *Attorney, Agent, or Firm* — Trevor Grove; John Vereb; Jody DeStefanis

(57) ABSTRACT

A tractor configured for grip locking during advancement to avoid slippage, particularly in open-hole wells. The tractor is equipped with a grip lock mechanism for independently locking an anchor grip in a radially outward direction. This locking occurs sequentially in advance of the power stroke of a reciprocating drive piston associated with the anchor. Thus, radial outward expansion and gripping are ensured at the time pulling of a load in an axial downhole direction is pursued. Such grip locking may be employed throughout tractoring or intermittently, depending upon well characteristics such as formation hardness and well diameter.

21 Claims, 6 Drawing Sheets

(56) References Cited

U.S. PATENT DOCUMENTS

| | | | | |
|---|---|---|---|---|
| 2003/0141078 | A1* | 7/2003 | Mackenzie | 166/381 |
| 2005/0034874 | A1* | 2/2005 | Guerrero et al. | 166/380 |
| 2005/0145415 | A1* | 7/2005 | Doering et al. | 175/24 |
| 2005/0247488 | A1* | 11/2005 | Mock et al. | 175/99 |
| 2006/0201716 | A1* | 9/2006 | Bloom et al. | 175/90 |
| 2007/0181298 | A1* | 8/2007 | Sheiretov et al. | 166/212 |
| 2007/0209806 | A1* | 9/2007 | Mock | 166/382 |
| 2008/0066963 | A1* | 3/2008 | Sheiretov et al. | 175/51 |
| 2008/0073077 | A1 | 3/2008 | Tunc et al. | |
| 2008/0149339 | A1* | 6/2008 | Krueger V | 166/301 |
| 2008/0196901 | A1* | 8/2008 | Aguirre et al. | 166/381 |
| 2008/0308318 | A1* | 12/2008 | Moore | 175/51 |
| 2009/0008152 | A1* | 1/2009 | Mock et al. | 175/99 |
| 2009/0159269 | A1* | 6/2009 | Sheiretov et al. | 166/216 |
| 2009/0236101 | A1 | 9/2009 | Nelson et al. | |
| 2010/0018720 | A1* | 1/2010 | Mock | 166/382 |
| 2010/0163251 | A1* | 7/2010 | Mock et al. | 166/382 |
| 2010/0263856 | A1* | 10/2010 | Lynde et al. | 166/53 |
| 2011/0048702 | A1* | 3/2011 | Jacob | 166/254.2 |
| 2011/0048801 | A1* | 3/2011 | Jacob | 175/45 |
| 2011/0127046 | A1* | 6/2011 | Aguirre et al. | 166/382 |
| 2011/0277990 | A1* | 11/2011 | Kotsonis et al. | 166/217 |
| 2012/0048541 | A1* | 3/2012 | Jacob | 166/254.2 |
| 2012/0048542 | A1* | 3/2012 | Jacob | 166/254.2 |

* cited by examiner

GRIP ENHANCED TRACTORING

FIELD

Embodiments described herein relate to tractors for delivering tools through hydrocarbon wells, particularly those of an open-hole variety. Embodiments of tractors are described which employ techniques and features to synchronize and control the forces present at the interface of tractor arms and the generally uncased wall of the well.

BACKGROUND

Downhole tractors are often employed to drive a downhole tool through a horizontal or highly deviated well at an oilfield. In this manner, the tool may be positioned at a well location of interest in spite of the non-vertical nature of such wells. Different configurations of downhole tractors may be employed for use in such a well. For example, a reciprocating tractor may be utilized which employs separate adjacent sondes with actuatable anchors for interchangeably engaging the well wall. That is, the sondes may be alternatingly immobilized with the anchors against the well wall and advanced in an inchworm-like fashion through the well.

During tractoring operations, the above-noted tractor may proceed downhole, along with several thousand pounds of equipment. The tractor and equipment may be driven thousands of feet into the well for performance of a downhole operation such as the logging operation described below. Regardless, in order to achieve sufficient tractor and equipment advancement, forces are imparted from the tractor toward the well wall through the noted anchors and/or traction elements. In theory, the tractor may thus avoid slippage and achieve the noted advancement through the well.

Often times, tractors are employed in open-hole or uncased wells. For example, a logging application to determine well characteristics may be run in advance of well casing. In this manner, a more direct evaluation of well conditions may be obtained in advance of casing or other downhole fixture placements. Unfortunately, advancement of the tractor through an open-hole well may face particular challenges. More specifically, in open-hole tractoring, the well is defined by the exposed formation alone. Thus, the well is likely to be variable in terms of wall surface characteristics, well diameter, etc. As described further below, the variability in wall surface characteristics in particular, may have a substantially adverse impact on the frictional footing each anchor is able to maintain as it engages the wall for advancement.

For an open-hole well, the degree of hardness or softness of the well wall may vary significantly over the span of several thousand feet of well. As a result, conventional tractoring may be rendered impractical in certain regions of the well due to the degree of softness found at the wall of exposed formation. In order to address this issue, an excess of expansion forces are often applied through the tractor's anchor arms. For example, with the load pulled in mind, forces that should be sufficient for maintaining a frictional footing at the interface of the anchor arms and softer well wall sections are employed to drive the tractor through the well.

Unfortunately, the use of excess expansion forces alone may lead to a host of other problems in terms of achieving proper tractor advancement. For example, in smaller diameter well sections of sufficient hardness, the tractor may simply end up damaging itself via attempts to unnecessarily over expand its anchor arms. Ultimately, this may lead to mechanical failure of the tractor as a result of over-stressed anchor arms. Furthermore, as described below, excess expansion forces may fail to even maintain frictional footing in the first place. That is, even with an unlimited supply of radial force available, softer portions of the well wall may deteriorate as a result of the axial load imparted on the tractor.

As indicated above, even with an unlimited amount of radial force available, frictional footing may be a challenge to maintain due to the axial load that is pulled by the tractor. For example, in order to maintain the inertia of the downhole advancing tractor, wireline cable and other equipment, the tractor generally proceeds downhole in a continuous manner. In other words, the axial load of the entire system is continuously being pulled downhole. As a result, the anchor arms are interchangeably acting not only to radially grab a foothold on the well wall, but also to simultaneously withstand and maintain the downhole pull of an ever increasing load of the system. Thus, there may be periods where a given anchor is responsible for maintaining the axial load of the entire system in spite of incomplete build up radial expansion forces through its arms. When this occurs at softer sections of the open-hole well, the wall surface is prone to crumble and the anchor may fail to maintain a frictional foothold, ultimately resulting in tractor slipping and ceasing of tractor operations.

SUMMARY

A method of tractoring downhole in an open-hole well is detailed. The method includes deploying tractor arms of a tractor to engage a wall of an open-hole well with a predetermined amount of force. The arms may thus be locked in position. Upon establishing of the grip, a load that is coupled to the tractor may be pulled through the well. In one embodiment, the pulling of the load may be accompanied by the imparting of additional amounts of force through the arms as the locked grip is maintained.

DETAILED DESCRIPTION

Embodiments are described with reference to certain open-hole tractor assemblies. Focus is drawn to tractor assemblies that are of multiple anchoring configurations. In particular, reciprocating bow anchoring tractor configurations are depicted in a downhole logging application. However, a variety of alternate reciprocating tractor types and applications may be employed in accordance with embodiments of the present application. Regardless, embodiments detailed herein include a tractor that employs a grip locking mechanism that is sequentially actuated in advance of the power stroke of a driving mechanism. Thus, a given anchor may be ensured adequate grip at the well wall in advance of downhole driving forces.

Figure 1:
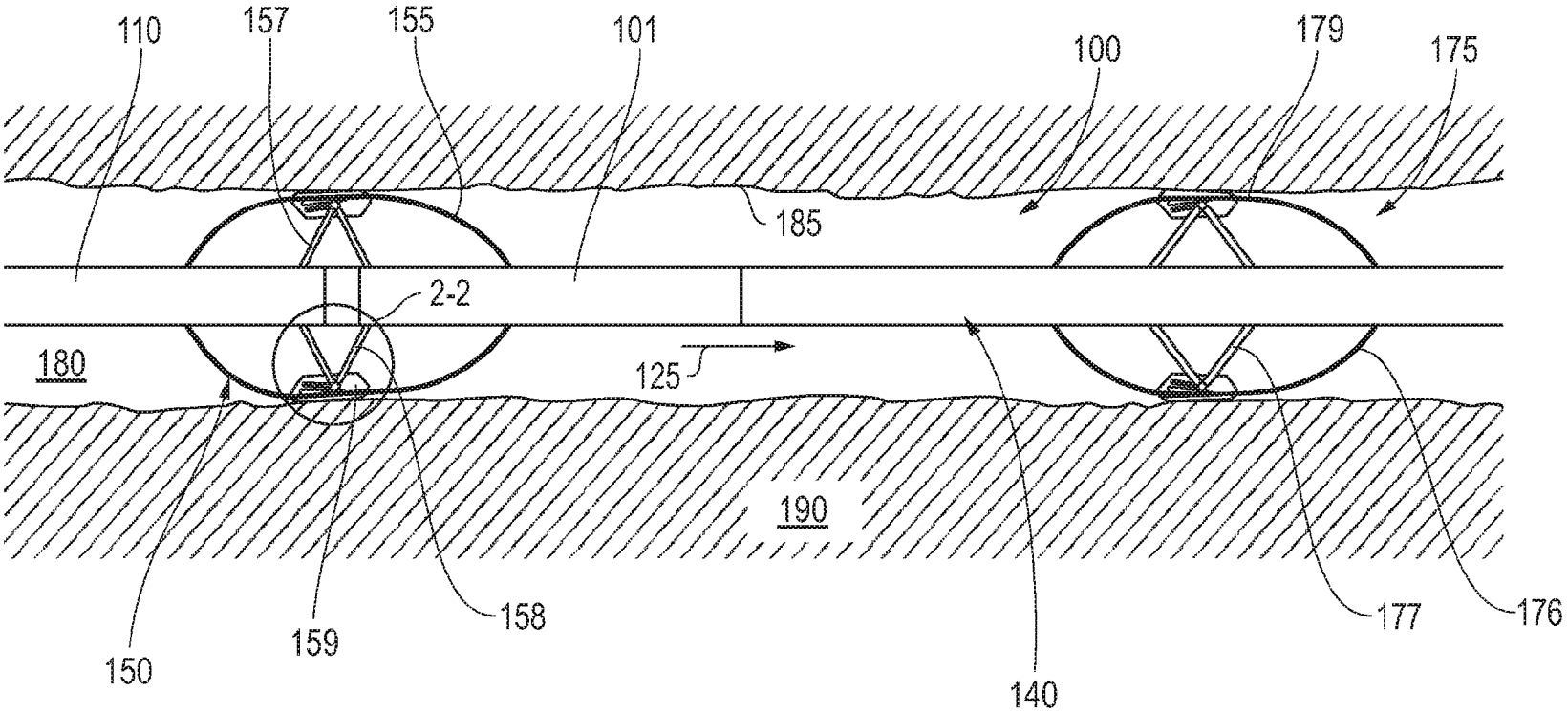
FIG. 1 is a partially sectional side view of an embodiment of a grip enhanced open-hole tractor.

Referring now to FIG. 1, a partially sectional side view of an embodiment of a grip enhanced open-hole tractor 100 is depicted. The open-hole well 180 traverses a formation 190 in a substantially deviated or horizontal fashion. Thus, access to the well may be fairly challenging. Therefore, a reciprocating tractor such as the depicted open-hole tractor 100 may be utilized in providing well access. To achieve such access, the tractor 100 is equipped with multiple anchors 150, 175 about a central shaft 140. The anchors are configured to interchangeably engage a wall 185 of the well 180. As such, the tractor 100 may proceed in an inchworm-like manner, pulling various equipment and associated axial load in a downhole direction (see arrow 125).

The well 180 of FIG. 1 may have a great degree of variability in terms of hardness at its wall 185. Thus, as detailed further below, the anchors 150, 175 are equipped with appropriately shaped gripping saddles 159, 179 for engagement of the wall 185. Additionally, the well 180 may be quite variable in diameter. As such, the anchors 150, 175 are configured to interchangeably expand and contract in a dynamically radial manner as also described below.

In the embodiment shown, the above noted radial expansion is achieved through radially expanding bow springs 155, 176 as directed by anchor arms 157, 177. However, alternate forms of radially expanding members may be utilized to interchangeably extend outward and contact the well wall 185. Regardless, the bow springs 155, 176 help to ensure an adequate grip is maintained at all times between at least one of the anchors 150, 175 and the wall 185. More specifically, in the embodiment shown, the bow springs 155, 176 serve to ensure that an adequate grip is interchangeably maintained at the interface 286 of the saddles 159, 179 and the well wall 185 (see also FIG. 2). That is to say, as detailed further below, an adequate grip is interchangeably maintained by the anchors 150, 179 as the load of the tractor 100 proceeds in an axial downhole direction 125.

Figure 3:
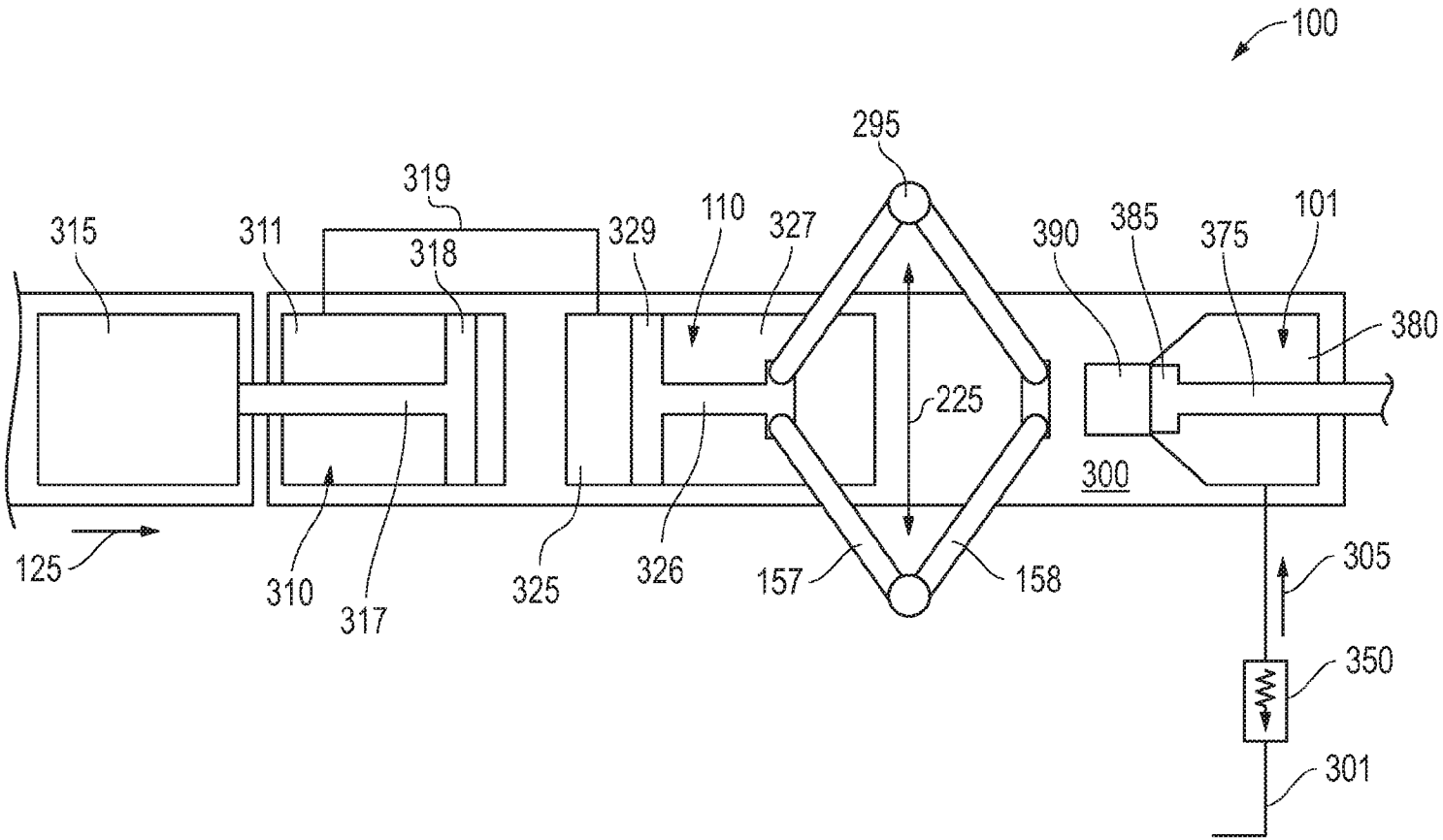
FIG. 3 is schematic overview of a portion of the grip enhanced open-hole tractor of FIG. 1 revealing hydraulics thereof.

With added reference to FIG. 3, the tractor 100 and all associated axial load proceeds downhole as described above in a substantially continuous manner. This is achieved by the sequential actuation of a grip lock mechanism 101 in advance of the power stroke of a drive system 315 responsible for pulling the axial load downhole. An extension mechanism 110 is also provided which drives up forces on the grip of the anchors 150, 175 at the wall 185.

In the embodiment of FIG. 1, the above noted grip lock mechanism 101, drive system 315, and extension mechanism 110 are incorporated into the central shaft 140 and depicted in relation to the uphole anchor 150. However, these features 101, 315, 110 may also be synchronized for use in conjunction with the downhole anchor 175. Alternatively, similar dedicated grip locking, driving, and extension features may be provided specifically for the downhole anchor 175. Regardless, as noted above, the sequential actuation of the grip lock mechanism 101 in advance of the power stroke of the drive system 315, ensures that continuous downhole tractor advancement may be maintained without undue slipping, irrespective of the potentially soft nature of the well wall 185.

Figure 2:
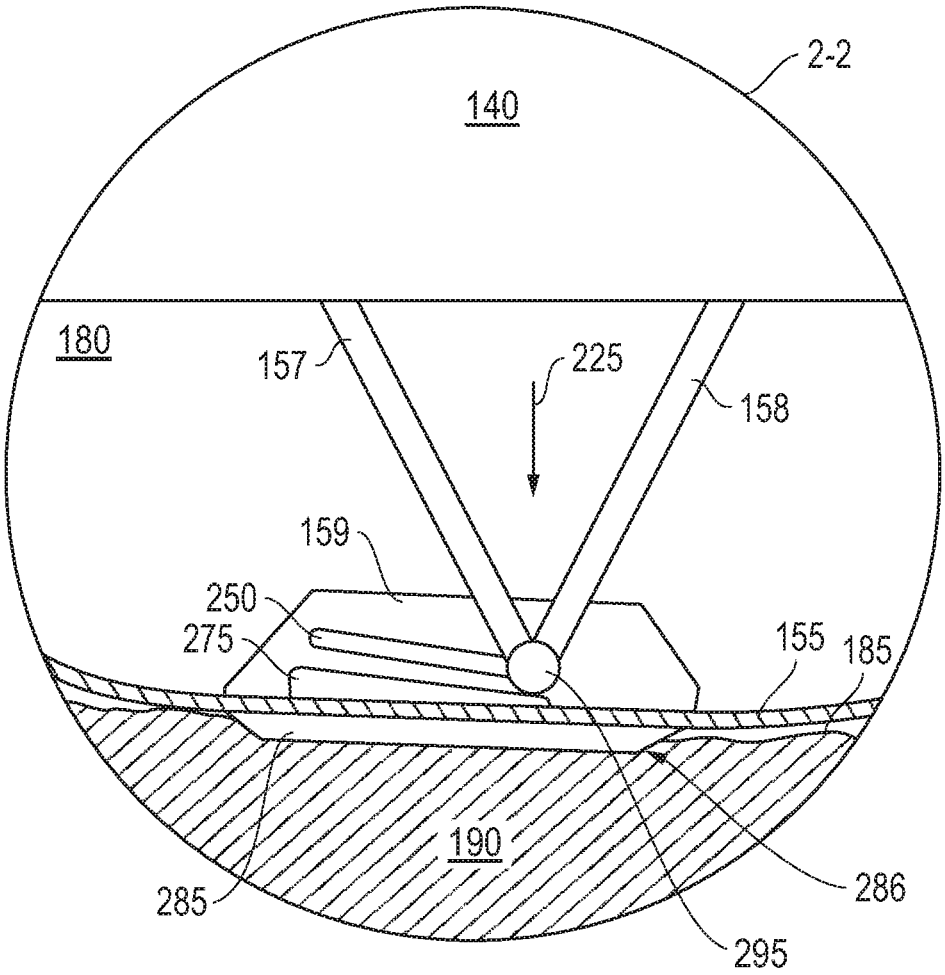
FIG. 2 is an enlarged view of an embodiment of a radially secured gripping saddle taken from 2-2 of FIG. 1.

Continuing with added reference to FIG. 2, an enlarged view of a portion of one of the anchors 150, 175 is depicted. More specifically, a gripping saddle 159 is shown, about a bow spring 155 of the uphole anchor 150 at the location of an interface 286 with the well wall 185. In fact, the gripping saddle 159 is equipped with a surface element 285 which may be forcibly sunken into the formation 190 to a degree at the interface 286. That is, as alluded to above, the gripping saddle 159 may be radially expanded away from the central shaft 140 of the tractor 100 by way of arms 157, 158. This is achieved as the uphole 157 and downhole 158 arms are brought closer together, thereby forcibly extending a pivot wheel 295 away from the central shaft 140.

In the embodiment shown, the pivot wheel 295 is coupled to each of the noted arms 157, 158 and slidably disposed within a recess guide 250 of the saddle 159. Thus, as the pivot wheel 295 is outwardly extended, the entire saddle 159 is driven in a radial outward direction (see arrow 225). Further, in the depicted embodiment, the recess guide 250 is at a bit of an incline and an adjacently parallel incline ramp 275 is also provided along which the wheel 295 may run. Thus, while a degree of axial mobility is possible, the wheel 295 is naturally encouraged to remain at the bottom of the incline, maximizing forces in the radial outward direction 225. As a result, the surface element 285 may be sunk into the formation 190 to a degree, depending on the level of hardness or softness thereof. Regardless, a secure grip may be established at the interface 286.

Perhaps more significantly, however, is the fact that the establishment of a secure grip as described above is achieved prior to the power stroke of the drive system 315 as shown in FIGS. 1 and 3. In other words, sequentially, the saddle 159 is forced in the outward direction 225, a firm grip locked in place, and then the power stroke of a drive system 315 pulls the load of the tractor 100 in an axial downhole direction 125. Thus, slipping of the saddle 159 relative to the well wall 185 as a result of premature pulling in the axial direction 125 (e.g. before a firm grip is established) may be substantially avoided. With reference to schematic FIGS. 3, 4A, and 4B, an embodiment of utilizing a grip lock mechanism 101 to sequentially ensure a firm grip is achieved in advance of a power stroke of drive system 315 is described in detail below. Through such an embodiment, load is pulled in an axial direction 125 as shown in FIG. 1, once a firm grip is fully established in the radial direction 225 as shown in FIG. 2.

Referring now to FIG. 3, a schematic overview of a portion of the tractor 100 of FIG. 1 is depicted. In this schematic view, the hydraulically driven nature of the tractor 100 is revealed The tractor 100 is depicted with a hydraulic housing 300 laterally mobile relative a drive system 315 of the tractor. The hydraulic housing 300 accommodates pivot wheels 295 somewhat extended in a radial direction 225 as noted above. This is achieved in part by the locking of the grip lock mechanism 101 as described below and enhanced by the responsiveness of the downhole arms 157 to the above noted extension mechanism 110. More specifically, the downhole arms 157 may be brought in closer proximity to the uphole arms 158 by the mechanism 110. This occurs as a head 329 of an extension piston 326 responds to a buildup of hydraulic pressure in an uphole chamber 325 of the mechanism 110 (e.g. as compared to pressure, in a downhole chamber 327 of the mechanism 110).

In the embodiment of FIG. 3, the locking of arm expansion at a minimum level may be ensured by the grip lock mechanism 101 in advance of further expansion and/or movement in the axial downhole direction 125. More specifically, a sealable chamber 390 of the mechanism 101 may be sealed by a head 385 of a reciprocating lock piston 375. The piston 375 may then be locked in place by closing off a solenoid 350 in hydraulic communication with a back side of the head 385. As such, the entire hydraulic housing 300 may be axially immobilized. In this manner, the pivot wheels 295, which are ultimately coupled to the housing 300 may be extended and locked in a radial direction 225 to a predetermined minimal level. That is, the pivot wheels 295 may not be brought closer to one another without unsealing of the sealable chamber 390 and movement of the housing 300 in a downhole direction.

As described further below, a drive system 315 is provided which employs a reciprocating drive piston 317 and is ultimately responsible for pulling the load of the tractor in an axial downhole direction 125 along with any associated equipment and tools. The above described lock mechanism 101 may by in hydraulic synch with the reciprocating drive piston 317 for sealing and unsealing of the sealable chamber 390. In this manner, locking of the grip lock mechanism 101 in advance of power stroking of the drive piston 317 may be achieved. That is, locking of radial grip forces in advance of axial load pulling forces may be ensured so as to avoid slippage of the tractor 100 in the well 180 (see FIG. 1).

With specific reference to the grip lock mechanism 101 above, a bottleneck configuration is employed which includes the noted sealable chamber 390 along with a larger belly 380. The reciprocating lock piston 375 includes the noted head 385 for periodically sealing off the sealable chamber 390. However, during periods in which the head 385 is disposed in the belly 380, no sealing occurs relative to the mechanism 101. As indicated above, the lock piston 375 is synchronized with the drive piston 317 such that the sealing of the sealable chamber 390 occurs immediately in advance of the power stroke of the drive piston 317. Again, this particular timing helps to ensure a minimum adequate grip is achieved prior to the power stroke.

Continuing with reference to FIG. 3, with added reference to FIG. 1, the cycling or reciprocating of the lock piston 375 may be synchronized with that of the drive piston 317. However, added direct control over the lock piston 375 may be achieved through an influx of hydraulic fluid 305 into the belly 380 of the lock mechanism 101. For example, a supplemental line 301 with available reservoir may be in fluid communication with the belly 380. Additionally, an influx of hydraulic fluid 305 may be directed to pressurize the belly 380 in conjunction with locking of the piston head 385 in the sealable chamber 390. Thus, the immobilizing of the hydraulic housing 300 may be tailored. As such, the entire grip of the anchor 150 is locked with an individually tailored minimum predetermined amount of force in advance of the power stroke of the drive piston 317. Stated another way, the availability of additional hydraulic pressure through the lock line 301 allows the user to tailor the exact amount of forces imparted in the radial outward direction 225 before locking the solenoid 350. This allows a user to tailor gripping in a dynamic manner during tractoring, depending on the nature of the well 180 and conditions at the wall 185. So, for example, as described further below, a control unit 612 may be employed to lock a grip at 2,500 lbs. in one section of the well 180, at 5,000 lbs. in another section, and to forego supplemental grip locking altogether in yet another section (see FIG. 6).

Continuing with reference to FIG. 3, the alluded to drive system 315 employs a conventional reciprocating drive piston 317 with piston head 318 disposed in an adjacent drive chamber 310. As indicated, the drive system 315 and piston 317 are configured for driving the tractor 100 downhole. More specifically, the system 315 is configured to pull the load of the tractor 100 and associated equipment in an axial downhole direction 125. This is achieved as the piston 317 performs a power stroke (i.e. moving in the uphole or leftward direction as depicted in FIG. 3). However, as described above, in advance of this power stroke, embodiments herein lock in a minimum amount of radial force through anchor arms 157, 158. As such, sufficient gripping is ensured to allow the power stroke to pull the tractor 100 in the axial downhole direction 125 without slipping.

In the embodiment of FIG. 3, the reciprocation of the drive piston 317 also serves to periodically provide additional or supplemental pressure to the uphole chamber 325 of the extension mechanism 110. Thus, while a minimum amount of pressure is ensured in advance of the power stroke, even more hydraulic pressure may be directed into the chamber 325 during the stroke. That is, as the drive piston 317 moves uphole during the power stroke, additional hydraulic fluid may be driven over the drive line 319 into the uphole chamber 325. Ultimately, as detailed further below, this means that additional force will be directed through the pivot wheels 295 and ultimately to the grip of the anchor 150 simultaneous with the anchor 150 taking on the noted axial load arising from the power stroke.

Figure 4A:
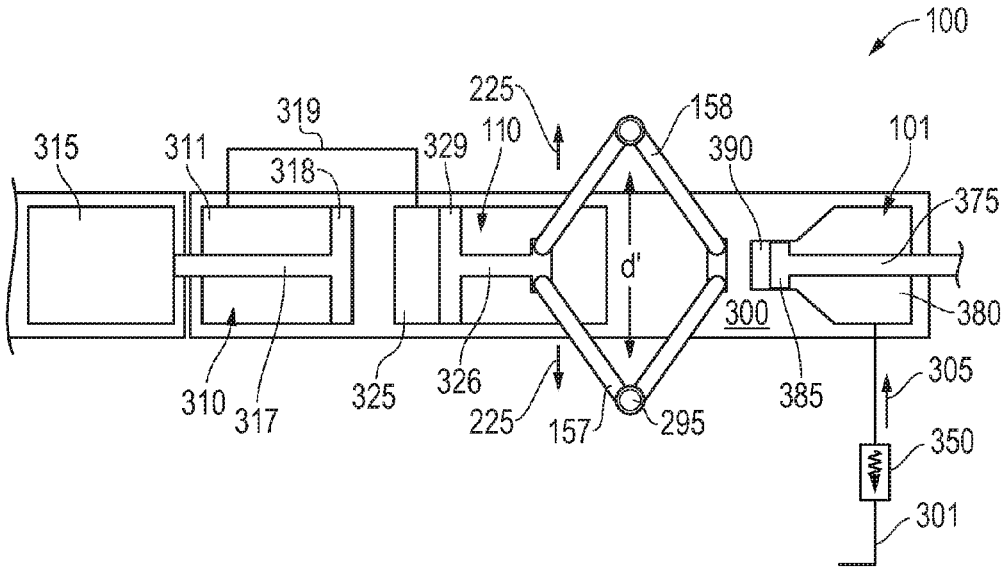
FIG. 4A is a schematic overview of the grip enhanced open-hole tractor of FIG. 3 in a radially secured gripping position.
Figure 4B:
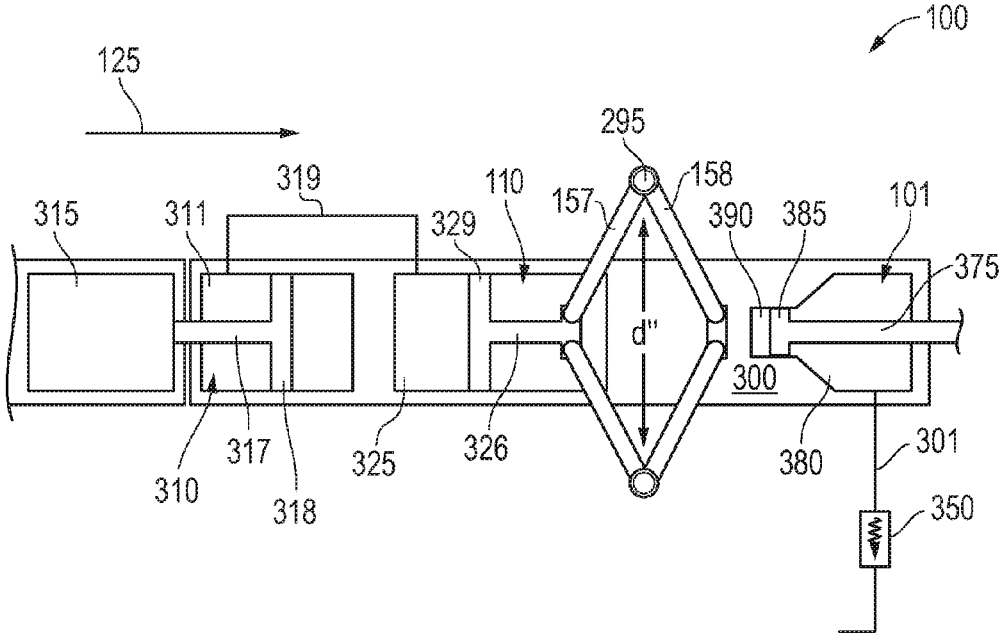
FIG. 4B is a schematic overview of the grip enhanced open-hole tractor of FIG. 3 with axially driven positioning.

With reference to FIGS. 4A and 4B, detailed further below, a closer examination of the inner-workings of the grip enhanced open-hole tractor 100 is described. Namely, FIG. 4A reveals the grip locking nature of the tractor 100 whereas FIG. 4B reveals the sequentially subsequent power stroking and load pull of the tractor 100.

As indicated, FIG. 4A reveals the grip locking nature of the grip lock mechanism 101 ensuring anchor arms 157, 158 extending in the radial outward direction 225. In FIG. 4A, a minimum distance d' is ensured between the pivot wheels 295 and thus, a minimum grip translated through the saddles 159 and to the interface 286 of FIGS. 1 and 2. While the embodiment depicted reveals a hydraulic manner of ensuring the minimum distance d', other techniques for locking or ensuring such a minimum position of the anchor arms 157, 158 may be employed. For example, a movable mechanical collar, electrically driven motor, or magnetically actuated feature may be utilized to ensure the minimum distance d' of the arms 157, 158.

With added reference to FIG. 1, FIG. 4A, depicts the head 385 of the locking piston 375 disposed in the sealable chamber 390 of the grip lock mechanism 101. Thus, as detailed above, a hydraulic lock may be imparted on the anchor arms 157, 158 as the hydraulic housing 300 is axially immobilized. As such, the noted minimum distance d' is ensured. Additionally, it is worth noting that at the time in which the minimum distance d' is initially secured, the drive piston 317 has not yet begun its power stroke (i.e. in the uphole direction through the uphole side 311 of the drive chamber 310). Therefore, the saddle 159 affiliated with the anchor arms 157, 158 has yet to fully accommodate the load of the tractor 100 to be pulled. That is to say, a minimum grip is first secured at the interface 286 prior to any substantial accommodation of axial load by the saddle 159 (see FIG. 2).

FIG. 4B reveals the sequentially subsequent power stroking of the drive piston 317 which is accompanied by advancement of the tractor 100 in the axial downhole direction 125. As shown, the power stroking of the drive piston 317 involves the piston 317 moving in the uphole direction through the uphole side 311 of the drive chamber 310. As such, the head 318 of the drive piston forces hydraulic fluid through the drive line 319. Thus, in the embodiment shown, the power stroking of the piston 317 is also accompanied by the buildup of additional pressure in the uphole chamber 325 of the extension mechanism 110. Therefore, a greater distance d" may be achieved between the wheels 295 as compared to the minimum distance d' of FIG. 4A. This may translate into forces at the gripping interface 286 of FIG. 2 being driven up simultaneously, or in conjunction, with the pulling or accommodating of load by the associated anchor 150 (see also FIG. 1). The result is that the likelihood of slipping at the interface 286 of FIG. 2, during the noted power stroking is even further reduced.

Figure 5:
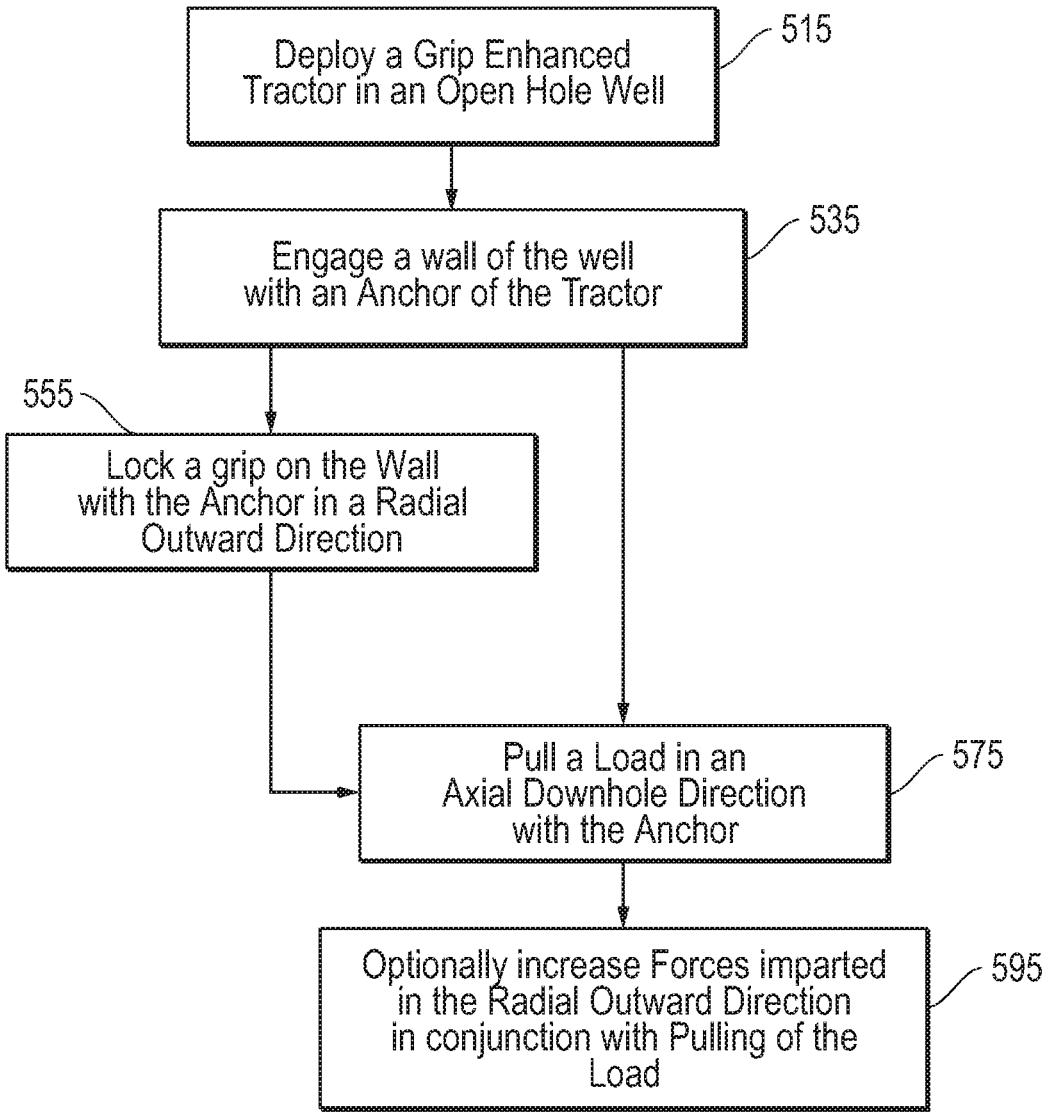
FIG. 5 is a flow-chart summarizing an embodiment of sequentially gripping and driving a grip enhanced open-hole tractor.

Referring now to FIG. 5, a flow-chart is shown summarizing an embodiment of sequentially gripping and driving a grip enhanced open-hole tractor as detailed hereinabove. Namely, once positioned in the open-hole well as indicated at 515, an anchor of the tractor may be employed to engage a wall of the well as indicated at 535 as with a conventional tractor. However, unlike a conventional tractor, embodiments of the grip enhanced tractor may employ features and techniques for locking a grip of the anchor on the wall as indicated at 555. This may take place in advance of power stroking or pulling a load with the anchor as indicated at 575. Additionally, embodiments described herein include the additional option of driving up gripping forces through the anchor as the load is pulled downhole (see 595).

Figure 6:
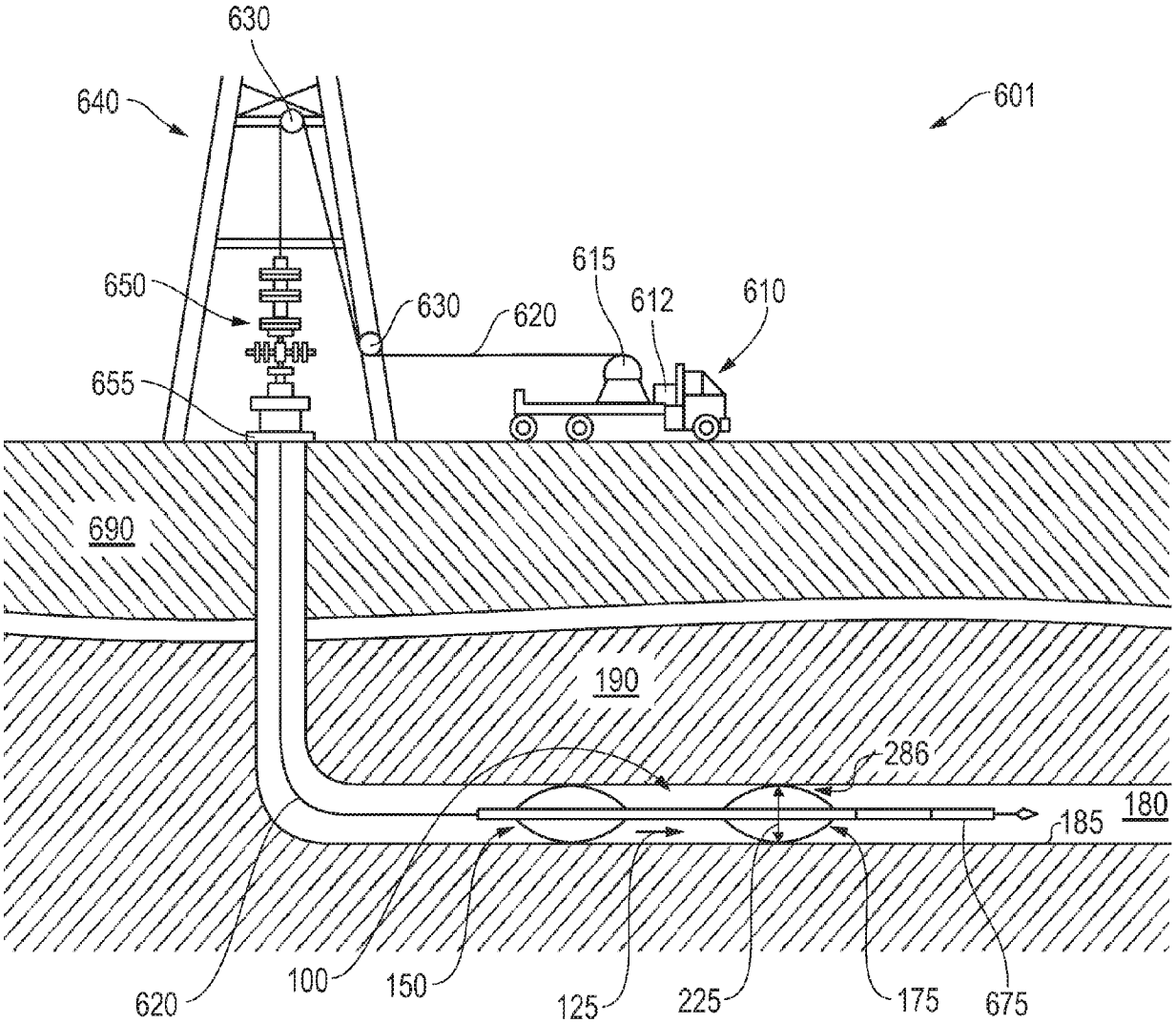
FIG. 6 is an overview of an oilfield with an open-hole well accommodating the grip enhanced open-hole tractor of FIG. 1 during a logging application.

Referring now to FIG. 6, an overview of an oilfield 601 is shown with the open-hole well 180 of FIG. 1 traversing various formation layers 690, 190. The well 180 accommodates the grip enhanced open-hole tractor 100 of FIG. 1 during a logging application with a logging tool 675. Access to a horizontal well section as shown may be challenging due to the deviated nature of the well 180 and potential depth involved, both of which compound the ability to deliver a tool in terms of the load involved. Furthermore, the open-hole nature of the well 180 means that substantial variability is likely in terms of well diameter and the hardness of the formation 190 at anchor interfaces 286. Nevertheless, as described below, the reciprocating tractor 100 is configured to interchangeably lock a grip of each anchor 150, 175 in such a manner so as to avoid slippage and ensure substantially continuous downhole advancement during an application.

Continuing with reference to FIG. 6, the tractor 100 and logging tool 675 are delivered by way of conventional wireline 620 from a wireline truck 610. However, alternate forms of conveyances may be employed. As shown, the truck 610 is equipped with a drum 615 and control unit 612 for guiding the wireline 620, tractor 100, and tool 675 over the course of operations. The wireline 620 is run through sheaves 630 at a rig 640 over the well 180. Then, in advance of traversing the well head 655, the wireline 620 is run through valving equipment 650, generally referred to as a "Christmas Tree" where a host of valving and pressure control parameters are maintained for the application.

Once downhole, the tractor 100 may be employed to reciprocate and interchangeably engage each anchor 150, 175 with the well wall 185. Depending on the overall profile of the well 180 in terms of varying diameter, hardness, etc., the control unit 612 may direct the tractor 100 to employ grip locking as detailed hereinabove. For example, in certain circumstances, well conditions may dictate that with every engagement of an anchor 150, 175 with the well wall 185, grip locking be employed in advance of power stroking. Alternatively, for example, well conditions may efficiently allow for the control unit 612 to direct grip locking only in particularly soft wall 185 sections of the well 180, without any undue concern over slipping at interfaces 286 of other well sections. Regardless, where helpful to avoid slipping, the tractor 100 is equipped with features that ensure a minimum amount of force is imparted in a radial outward direction 225 prior to an anchor 150, 175 taking on a pulled load in an axial downhole direction 125.

Embodiments detailed hereinabove provide techniques and assemblies that help avoid slippage of downhole tractors during open-hole well applications. In certain embodiments, this is achieved in a manner that allows for the tractor to continue reciprocation in a substantially continuous manner. As utilized herein, the term "substantially continuous" is meant to refer to circumstances where the actual time between grip locking and power stroking is limited to no more that about 50 milliseconds. Thus, the inertia of continuous downhole pull is not compromised by the addition of the grip locking features and techniques detailed herein. With such continuous reciprocation and the avoidance of slippage due to the noted grip locking features, embodiments of the tractor detailed herein may be employed to allow for continuous downhole advancement, reaching substantially greater open-hole well depths than previously attainable. Of course, other embodiments may be employed which take advantage of grip locking in advance of power stroking without necessarily employing substantially continuous movement as described here.

The preceding description has been presented with reference to presently preferred embodiments of the invention. Persons skilled in the art and technology to which this invention pertains will appreciate that alterations and changes in the described structures and methods of operation can be practiced without meaningfully departing from the principle, and scope of this invention. For example, while not alluded to in detail, embodiments described herein may be utilized in cased wells in addition to open-hole wells. By the same token, while embodiments are depicted herein as generally advancing in a downhole direction, equipment, tools and techniques described herein may be employed for uphole tractoring as well. Regardless, the foregoing description should not be read as pertaining only to the precise structures described and shown in the accompanying drawings, but rather should be read as consistent with and as support for the following claims, which are to have their fullest and fairest scope.

We claim:

1. A method of downhole tractoring in a well, the method comprising:

deploying radially expanding members of a tractor anchor to a predetermined minimum level of radial expansion, the tractor anchor comprising a hydraulic housing, the members extending from hydraulic housing;

locking the members with a hydraulically actuated grip lock mechanism disposed in the hydraulic housing at the predetermined minimum level and at a predetermined amount of gripping force to substantially secure a grip at a wall of the well thereby, the lock mechanism axially immobilizing the members and the hydraulic housing when locked; and employing the tractor anchor to pull a load in an axial downhole direction upon said locking, the lock mechanism preventing inward radial movement of the members while pulling the load.

2. The method of claim 1 wherein said employing is initiated within 100 milliseconds of said locking to ensure substantially continuous downhole tractoring.

3. The method of claim 1 further comprising expanding the members beyond the predetermined level during the employing to enhance the grip.

4. The method of claim 1 further comprising:

establishing a profile of well characteristics;

utilizing a control unit to establish dynamic values for the predetermined level of expansion based on the well characteristics; and directing said locking with the control unit based on the dynamic values.

5. The method of claim 1 wherein locking comprises sealing a sealable hydraulic chamber of the hydraulic housing accommodating the members and the grip lock mechanism, the hydraulic housing further defining at least a drive piston and an extension piston.

6. The method of claim 5 wherein said sealing comprises reciprocating a head of a piston into sealing engagement with the sealable hydraulic chamber.

7. The method of claim 6 further comprising hydraulically closing off a solenoid in fluid communication with the head for immobilization thereof.

8. The method of claim 7 wherein the sealing engagement is an initial sealing engagement, the method further comprising driving the head into the sealable hydraulic chamber beyond the initial sealing engagement prior to said closing off of the solenoid to tailor the gripping force at the wall.

9. The method of claim 1 further comprising driving up the gripping forces during the employing to enhance the grip.

10. A grip enhanced tractor comprising:

radially expanding members of a tractor anchor for interfacing a wall of a well, the members extending from a hydraulic housing of the tractor anchor;

a hydraulically actuated grip lock mechanism and at least a drive piston disposed in the hydraulic housing and coupled to the members for establishing a predetermined minimum level of expansion to secure a grip and axially immobilize the hydraulic housing during the interfacing; and a drive system coupled to the members, the drive piston, and the grip lock mechanism to direct pulling a load in an axial direction therewith when the minimum level of expansion is established.

11. The grip enhanced tractor of claim 10 wherein the well is uncased and the predetermined minimum level is established in light thereof.

12. The grip enhanced tractor of claim 10 wherein the radially expanding members comprise:

expandable bow springs;

gripping saddles secured at a side of said bow springs to contact the wall during the interfacing; and deployable anchor arms coupled to an opposite side of said springs to actuate the interfacing.

13. The grip enhanced tractor of claim 10 wherein said hydraulically actuated lock comprises:

a bottleneck housing defining a sealable chamber contiguous with a larger diameter belly; and lock piston disposed within said housing and having a head for sealing the sealable chamber relative the belly, exclusively upon communication with said sealable chamber.

14. The grip enhanced tractor of claim 13 further comprising a solenoid in hydraulic communication with the belly and configured for immobilizing the head in sealable communication with the sealable chamber via hydraulically locking pressure in the belly.

15. The grip enhanced tractor of claim 13 wherein said drive system comprises a drive piston in reciprocating synch with said lock piston to ensure the establishing of the predetermined minimum level sequentially in advance of the pulling of the load.

16. The grip enhanced tractor of claim 15 wherein said hydraulically actuated lock and said drive system are coupled to said members through an extension mechanism responsive to each of said lock piston and said drive piston, respectively.

17. The grip enhanced tractor of claim 16 wherein said drive piston is configured to direct expansion of the members beyond the predetermined minimum level during the pulling of the load.

18. The grip enhanced tractor of claim 10 further comprising an extension piston disposed in the hydraulic housing.

19. A tractor system for deploying in an open hole well and comprising:

a reciprocating tractor comprising a hydraulic housing, the housing defining a hydraulic grip lock mechanism, a drive piston, and an extension piston therein, the lock mechanism, drive piston, and extension piston operatively coupled to a drive system and a plurality of radially expanding members, the lock mechanism configured to ensure a predetermined minimum level of radial outward anchor expansion sequentially in advance of load pulling in a downhole axial direction within the well; and a control unit coupled to said tractor and positioned at an oilfield surface adjacent the well, the control unit configured to direct the grip lock mechanism for tailoring the degree of anchor expansion and a degree of gripping force throughout the deploying.

20. The tractor system of claim 19 further comprising an application tool coupled to said tractor, said control unit configured to direct said application tool via wireline communication.

21. The tractor system of claim 20 wherein said application tool is a logging tool.

* * * * *